US005512398A

United States Patent [19]

Foster et al.

[11] Patent Number: 5,512,398

[45] Date of Patent: Apr. 30, 1996

[54] DIAGNOSTIC METHOD FOR DETERMINING AGITATION LEVELS IN LOW VOLUME THIN TANKS

[75] Inventors: David G. Foster, W. Henrietta; John H. Rosenburgh, Hilton, both of N.Y.

[73] Assignee: Eastman Kodak Company, Rochester, N.Y.

[21] Appl. No.: 389,373

[22] Filed: Feb. 16, 1995

[51] Int. Cl.[6] ..... G03C 5/02; G03C 5/38

[52] U.S. Cl. ..... 430/30; 430/455; 354/298; 354/325; 354/297

[58] Field of Search ..... 430/30, 455; 354/298, 354/325, 297

[56] References Cited

U.S. PATENT DOCUMENTS

| | | | |
|---|---|---|---|
| 3,753,652 | 8/1973 | Gassmann et al. | 430/164 |
| 3,787,874 | 1/1974 | Urban | 436/2 |
| 4,881,095 | 11/1989 | Shidara | 354/298 |
| 4,985,320 | 1/1991 | Griffin | 430/30 |
| 5,223,359 | 6/1993 | Shelton et al. | 430/30 |
| 5,243,373 | 9/1993 | Glover et al. | 354/320 |
| 5,270,762 | 12/1993 | Rosenburgh et al. | 354/324 |
| 5,420,659 | 5/1995 | Manico et al. | 354/320 |

*Primary Examiner*—Mark F. Huff
*Attorney, Agent, or Firm*—Christopher J. Fildes

[57] ABSTRACT

A diagnostic method for testing agitation of a photographic processing solution in a processing tank for a photographic processing apparatus of the type having a nozzle and adapted in use to impinge the photographic processing solution onto a photographic emulsion includes the steps of charging the processing tank with a solution containing a silver solvent, processing the photographic emulsion, and testing the processed photographic emulsion for patterns of silver remaining in the photographic emulsion, wherein such patterns are indicative of nozzle obstructions and thereby agitation levels present in the processing tank.

9 Claims, 1 Drawing Sheet

DIAGNOSTIC METHOD FOR DETERMINING AGITATION LEVELS IN LOW VOLUME THIN TANKS

FIELD OF THE INVENTION

This invention relates to a diagnostic method for testing fluid delivery onto photographic emulsions in a photographic processing system and more particularly to a diagnostic method for determining the presence of nozzle obstructions, which can be an indication of agitation levels of a photographic processing solution in a low volume thin tank configuration processor.

BACKGROUND OF THE INVENTION

Agitation levels in photographic processors incorporating the low volume thin tank configuration are calculated and controlled by means of pressure sensors and gauges or some other means. During the normal use of such a processor configuration to process photographic emulsions, nozzles or outlets for the various solutions may become partially clogged or otherwise obstructed. Oftentimes the clogging is the result of insufficient agitation. Sensitivities to agitation are commonplace in systems like photographic processing which are diffusion controlled.

Methods currently used to determine fluctuations in agitation levels include visual examination and observations of sensitometric differences during and following processing. Sensitometric differences include comparing the change in density of a developed image in terms of the quantity of exposure to light to find the optimum condition for processing. The problem with both of these methods is that it is very difficult to accurately determine where and when the fluctuations are occurring. The visual method is very subjective and thus inherently inaccurate. Observation from sensitometric data during processing are inaccurate because other factors are oftentimes influencing the data such as chemical concentrations, temperature, etc. The use of such a method makes it very difficult to accurately pinpoint the cause of data differences.

SUMMARY OF THE INVENTION

The present invention provides a method of diagnosing fluctuations in agitation levels in photographic processors which permits determining the potential agitation differences in a way that is void of subjective inaccuracies, and is easy to obtain. Accordingly, the present invention provides an easy means of determining whether there are agitation differences or fluctuations in low volume thin tank configured processors. This method is generally intended for use in the low volume thin tank processing configuration but is applicable in any system in which the photographic processing solutions are communicated through nozzles and impinged onto the photographic emulsion.

According to the present invention, the method is characterized by charging a processing tank with a dilute solution containing a silver solvent, such as a fixer solution containing ammonium thiosulfate, sodium thiosulfate, or potassium thiosulfate. The photographic emulsion is processed and subjected to testing for patterns of silver remaining in the photographic emulsion after the processing. The remaining silver patterns are indicative of silver solvent delivery onto the emulsion and thereby an indication of agitation levels present in the processing tank. This method is also useful for testing nozzle operation.

These and other features and advantages of the invention will be more fully understood from the following detailed description of the invention taken together with the accompanying drawings.

DETAILED DESCRIPTION OF THE INVENTION

According to the present invention, a dilute solution containing a silver solvent agent is charged into the processing tank of a photographic processing apparatus of the type having a passage of limited dimensions to define a low volume processing area and a plurality of nozzles adapted and used to impinge photographic processing solution onto a photographic emulsion. A photographic processing apparatus of this type is described in U.S. Pat. No. 5,243,373. The dilute solution or silver solvent is charged into the processing tank where a measurement of agitation is desired.

The dilute solution is an aqueous solution containing an inorganic salt and selected from the group consisting of ammonium thiosulfate, sodium thiosulfate, and potassium thiosulfate. This dilute solution has a silver solvent concentration in the range of approximately from 40 to 80% of the silver solvent solution typically used to process a photographic emulsion. A silver solvent solution typically used to process a photographic emulsion is often referred to as a fixing agent. Therein, the silver solvent is usually present in a concentration of about 121.9 grams per liter, or 0.82 moles per liter. Preferably the dilute solution used in the diagnostic method has a concentration of silver solvent in the range of 40 to 65% of the concentration of silver solvents of a typical fixing agent.

Figure 1:
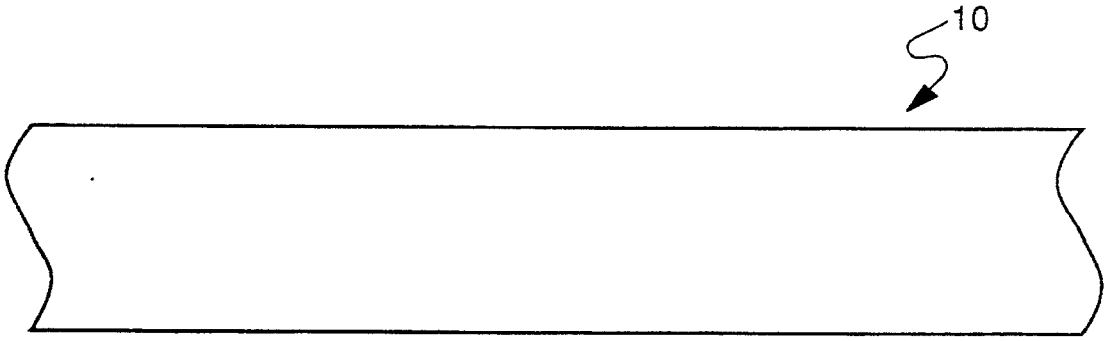
FIG. 1 is a schematic view of a photographic emulsion processed with a dilute solution containing a silver solvent in accordance with the present invention illustrating a uniform agitation test.

Once the processor is charged with the dilute silver solvent solution, the photographic emulsion is processed. No other solutions are necessary. The processed photographic emulsion is then subjected to visual examination for patterns of silver remaining in the photograph emulsion. By way of examples, FIG. 1 illustrates a processed photographic emulsion 10 wherein a uniform agitation level was present in the low volume thin tank. The arrow indicates the direction of the photosensitive material as it is processed. The uniform pattern of silver remaining on the emulsion 10 suggests that the agitation is both uniform and acceptable. The absence of any spotting or streaking indicates that none of the nozzles is obstructed.

Figure 2:
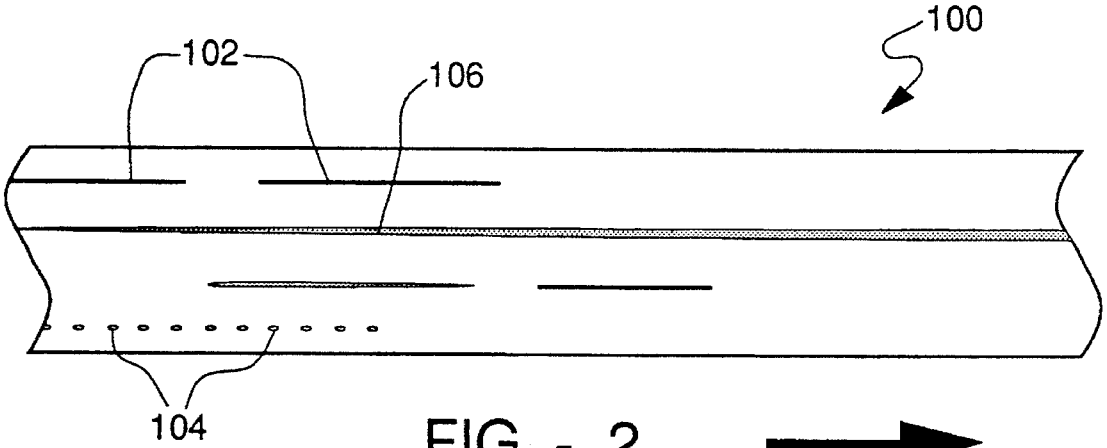
FIG. 2 is a schematic illustration of another processed photographic emulsion illustrating a partially obstructed non-uniform agitation test.

FIG. 2 illustrates a processed photographic emulsion 100 having a number of streaks 102, spots 104, and a continuous line 106. Like the example of FIG. 1, the arrow indicates the direction of the photosensitive media as it is processed. This example illustrates a non-uniform agitation level evidenced by partially or fully obstructed nozzles. The erratic nature of streaks 102 and spots 104 are representative of partially obstructed nozzles. The continuous line 106 illustrates a totally obstructed nozzle. The non-uniform pattern illustrates the absence of silver dissolution by the silver solvent. A non-uniform line thickness of streaks 102 or line 106 is an indication that the silver solvent solution is only partially obstructed from flowing. The starting and stopping of streaks 102 are affected by the magnitude and cause of an obstruction.

If the obstruction is due to large amounts or quantities of debris becoming lodged in a nozzle opening, the result in a more complete obstruction. However, if the obstruction is caused by some chemical precipitate that has become lodged and is blocking the nozzle, the precipitate may be dissolved, whereby the pattern due to the blockage would lessen. Alternatively the crystal could grow and become larger whereby the blockage would increase and the pattern formed would increase with time. This suggests that someone may test for non-uniform agitation, see some evidence of it, and not take care of the problem at that time. Rather, test for it again later to see if the blockage had lessened or worsened.

Another type of obstruction might be some small object which is caught in a nozzle unable to pass through the nozzle opening. Such an object may twirl or rotate with the force of the solution, causing an erratic pattern. Obviously there are numerous other possibilities.

Figure 3:
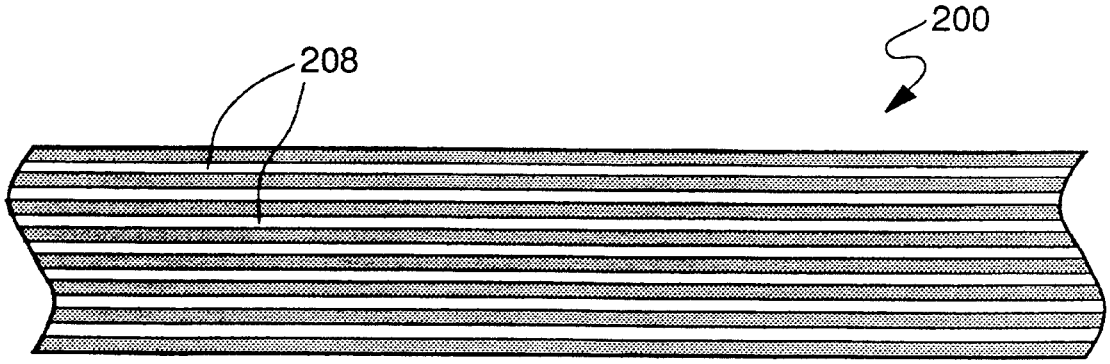
FIG. 3 is a schematic view illustrating still another processed photographic emulsion used to verify a nozzle design profile.

The drawing of FIG. 3 illustrates another processed photographic emulsion 200 and suggests that this method is also a useful tool to determine the operation of nozzles in a photographic processing system. The drawing of FIG. 3 illustrates an agitation design profile verification for seven nozzles as illustrated by lines 208. With this method it is easy to test to ensure that all the nozzles of the processor are functioning properly.

As can be seen from these examples, visible patterns are used to pinpoint areas where the agitation level has changed or a nozzle has become obstructed. In other cases, the photographic emulsions can be analytically tested to determine the quantity of silver remaining in different areas of the emulsion, and from these data the pattern of discontinuity can be deduced. These patterns are the result in differences in silver dissolution in different areas of the strip. Since the silver solvent agent is a dilute solution, complete fixing will not occur in any area of the photographic emulsion. If complete fixing did occur, the patterns caused by incomplete fixing would not be present.

This method can also be applied in systems having multiple processing tanks. However, it is desirable that only one of the tanks of the processor be charged with the silver solvent solution at a time. The simultaneous charging of multiple tanks may give confusing results as to in which tank the agitation level fluctuations are actually occurring.

Silver solvent solutions like fixer solutions are very applicable for this invention since the fixing processes is overall a process controlled by diffusion, and agitation has its greatest impact on diffusion.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

Parts List

10. photographic emulsion
100. photographic emulsion
102. streaks
104. spots
106. continuous line
200. photographic emulsion
208. line

What is claimed is:

1. A diagnostic method for testing fluid delivery of a photographic processing solution in a processing tank for a photographic processing apparatus of the type having a plurality of nozzles and adapted in use to impinge said photographic processing solution onto a photographic emulsion, the method characterized by:

charging said processing tank with a solution containing a silver solvent;

processing said photographic emulsion; and testing the processed photographic emulsion for patterns of silver remaining in the photographic emulsion, wherein such patterns are indicative of nozzle obstructions and thereby agitation levels present in said processing tank.

2. The method of claim 1 characterized in that said solution is a dilute solution containing a silver solvent agent.

3. The method of claim 1 characterized in that said solution is an aqueous solution containing an inorganic salt selected from the group consisting of ammonium thiosulfate, sodium thiosulfate, and potassium thiosulfate.

4. The method of claim 3 characterized in that said solution has a concentration of said inorganic salt in the range of 40 to 80 percent of the concentration of said salt in a typical photographic emulsion processing solution.

5. The method of claim 3 characterized in that said solution has a concentration of said inorganic salt in the range of 40 to 65 percent of the concentration of said salt in a typical photographic emulsion fixing agent.

6. The method of claim 1 characterized in that said testing includes visual examination of patterns of silver remaining in the processed photographic emulsion.

7. The method of claim 1 characterized in that said testing includes analytically testing the processed photographic emulsion to determine the quantity of silver remaining in different areas of said emulsion.

8. The method of claim 1 characterized in that said processing is incomplete fixing of said emulsion.

9. A diagnostic method for testing fluid delivery of a photographic processing solution in a processing tank for a photographic processing apparatus of the type having a nozzle adapted in use to impinge said photographic processing solution onto a photographic emulsion, the method characterized by:

charging said processing tank with a solution containing a silver solvent;

processing said photographic emulsion; and testing the processed photographic emulsion for patterns of silver remaining in the photographic emulsion, wherein such patterns are indicative of nozzle obstructions and thereby agitation levels present in said processing tank,

* * * * *